US007628686B2

(12) United States Patent
Rimmer et al.

(10) Patent No.: US 7,628,686 B2
(45) Date of Patent: Dec. 8, 2009

(54) MODULAR FLOOR TERMINAL BASKET WITH DAMPER

(75) Inventors: Julian Douglas Tyldesley Rimmer, Winnipeg (CA); Vasilios Oliver, Winnipeg (CA); Mike Nicholson, Winnipeg (CA)

(73) Assignee: E.H. Price Ltd., Winnipeg (CA)

( * ) Notice: Subject to any disclaimer, the term of this patent is extended or adjusted under 35 U.S.C. 154(b) by 241 days.

(21) Appl. No.: 11/380,290

(22) Filed: Apr. 26, 2006

(65) Prior Publication Data

US 2006/0246835 A1 Nov. 2, 2006

Related U.S. Application Data

(60) Provisional application No. 60/676,698, filed on Apr. 29, 2005.

(51) Int. Cl.
*F24F 13/10* (2006.01)

(52) U.S. Cl. ..... 454/290

(58) Field of Classification Search ..... 454/290
See application file for complete search history.

(56) References Cited

U.S. PATENT DOCUMENTS

| | | | |
|---|---|---|---|
| 4,417,687 | A | 11/1983 | Grant |
| 4,775,001 | A | 10/1988 | Ward |
| 5,058,490 | A | 10/1991 | Sodec et al. |
| 5,163,871 | A | 11/1992 | Huibregste |
| 5,607,354 | A | 3/1997 | Mill et al. |
| 5,674,125 | A | 10/1997 | Xia |
| 5,910,045 | A | 6/1999 | Aoki et al. |
| 5,938,525 | A | 8/1999 | Birdsong et al. |
| 6,019,677 | A | 2/2000 | Demster |
| 6,083,100 | A | 7/2000 | Hardy et al. |
| 6,099,406 | A | 8/2000 | Demster |
| 6,231,438 | B1 | 5/2001 | Laudermilk |
| 6,290,596 | B1 | 9/2001 | Birdsong et al. |
| 6,340,329 | B1 | 1/2002 | Park |

(Continued)

FOREIGN PATENT DOCUMENTS

| | | |
|---|---|---|
| CA | 1218438 | 2/1987 |

(Continued)

OTHER PUBLICATIONS

Translated JP 2001050576A document.*

*Primary Examiner*—Steve McAllister
*Assistant Examiner*—Helena Kosanovic
(74) *Attorney, Agent, or Firm*—Smith, Gambrell & Russell

(57) ABSTRACT

A modular floor terminal basket with a damper is mounted in the floor of an occupied space for delivering air from an under floor air plenum to the occupied space above. The modular floor terminal basket with a damper includes a generally cylindrical basket with air inlet openings on the basket side and an air outlet at the top of the basket. A damper is positioned in the basket for movement from a lower opened position to an upper closed position. The position of the damper is controlled by an actuator which in turn is controlled by a thermostat/controller in the occupied space above the floor. The damper is slideably mounted on a damper guide extending from the bottom of the basket toward the air outlet at the top of the basket. The actuator rotates a threaded shaft that engages a threaded collar attached to the damper so that the damper slides up and down along the damper guide.

1 Claim, 4 Drawing Sheets

U.S. PATENT DOCUMENTS

| | | | | |
|---|---|---|---|---|
| 6,361,432 | B1 | 3/2002 | Walker | |
| 6,544,117 | B1 | 4/2003 | Hardy | |
| 6,780,098 | B2 * | 8/2004 | Nishida et al. | 454/155 |
| 6,800,024 | B1 | 10/2004 | Prevost | |
| 2003/0139133 | A1 | 7/2003 | Hardy | |
| 2004/0198214 | A1 | 10/2004 | Karidis | |

FOREIGN PATENT DOCUMENTS

| | | | |
|---|---|---|---|
| CA | 2198642 | | 8/1998 |
| JP | 2001050576 | A * | 2/2001 |

* cited by examiner

MODULAR FLOOR TERMINAL BASKET WITH DAMPER

RELATED APPLICATION

This application claims the benefit of priority of U.S. provisional application Ser. No. 60/676698, filed Apr. 29, 2005, which is relied on and incorporated herein by reference.

FIELD OF THE INVENTION

This invention relates to a modular floor terminal basket with a vertically movable damper for use with an HVAC system having an under floor air plenum.

BACKGROUND OF THE INVENTION

In an HVAC system having an under floor air plenum, cool or warm air is supplied to the plenum below the floor of an occupied space to be cooled or heated. In order to cool or heat the occupied space above the floor, terminals with diffuser grilles are mounted in the floor at predetermined locations to allow the cool or warm air in the plenum to flow into the occupied space above the floor. The terminals are located and oriented to accommodate the configuration of the occupied space to be cooled or heated.

SUMMARY OF THE INVENTION

The modular floor terminal basket of the present invention is mounted in the floor of an occupied space for delivering air from an under floor air plenum to the occupied space above the floor through a diffuser grille. The modular floor terminal basket includes a round basket and a disk shaped damper. The basket has air inlet openings on the side circumference, an air outlet at the top of the basket, and a closed bottom. The diffuser grille covers the basket outlet and diffuses the air, in a predetermined flow pattern, into the occupied space above the floor. The disk shaped damper is positioned in the basket for vertical movement from a lower opened position to an upper closed position. The damper is slideably mounted on a damper guide within the basket. The vertical position of the damper along the damper guide is controlled by an electric motor which in turn is controlled by a thermostat/controller usually located in the occupied space above the floor. The motor is connected directly to and rotates a threaded screw drive. The threaded screw drive engages a threaded collar attached to the damper so that the damper slides up and down along the damper guide as the motor turns the threaded screw drive. As the damper slides up along the damper guide, the damper progressively closes off the side air inlet openings from communication with the air outlet at the top of the basket. As the damper slides down along the damper guide, the damper progressively opens the side air inlet openings for communication with the air outlet at the top of the basket.

A thermostat/controller control signal is supplied from the thermostat/controller to a signal converter that allows for convenient and easy plug and play installation. A modular control cable can be plugged into the signal converter. The signal controller also includes an output for the signal to be carried to the next terminal if installed in a daisy-chain manner.

A perforated plate may be located in the air outlet of the basket and serve as an equalization baffle, ensuring consistent flow from the air outlet to the diffuser grille. This plate also serves to catch debris that may fall into the basket from the occupied space through the diffuser grille.

Therefore, it is an object of the present invention to provide a modular floor terminal basket with a damper that will control the airflow from the under floor air plenum, through the diffuser grille, to the occupied space above the floor.

Further objects, features and advantages will become apparent upon consideration of the following detailed description of the invention when taken in conjunction with the drawing and the appended claims.

DETAILED DESCRIPTION OF THE PREFERRED EMBODIMENT

Figure 1:
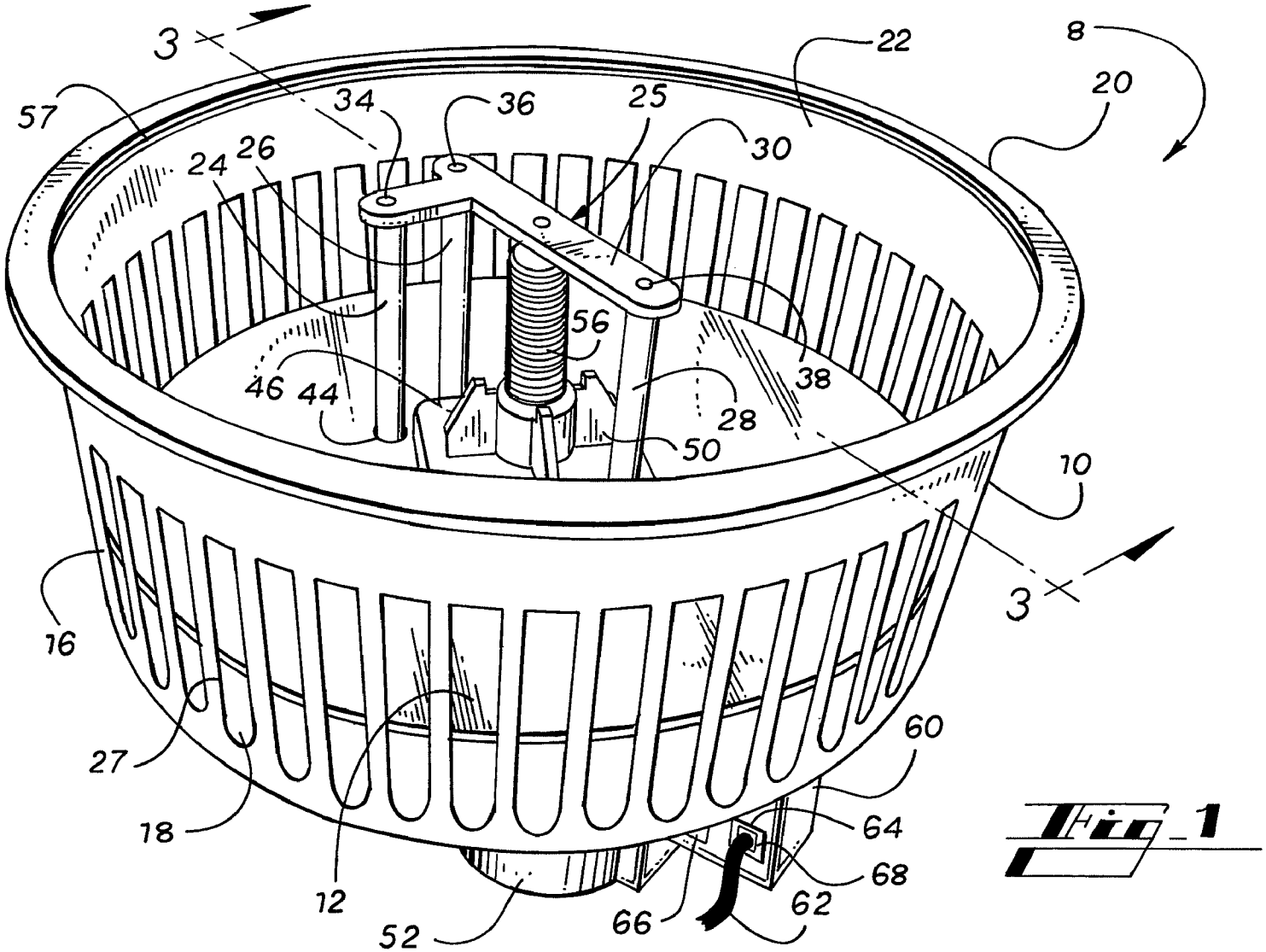
FIG. 1 is a side perspective view of a first embodiment of a modular floor terminal basket with a damper in accordance with the present invention.
Figure 2:
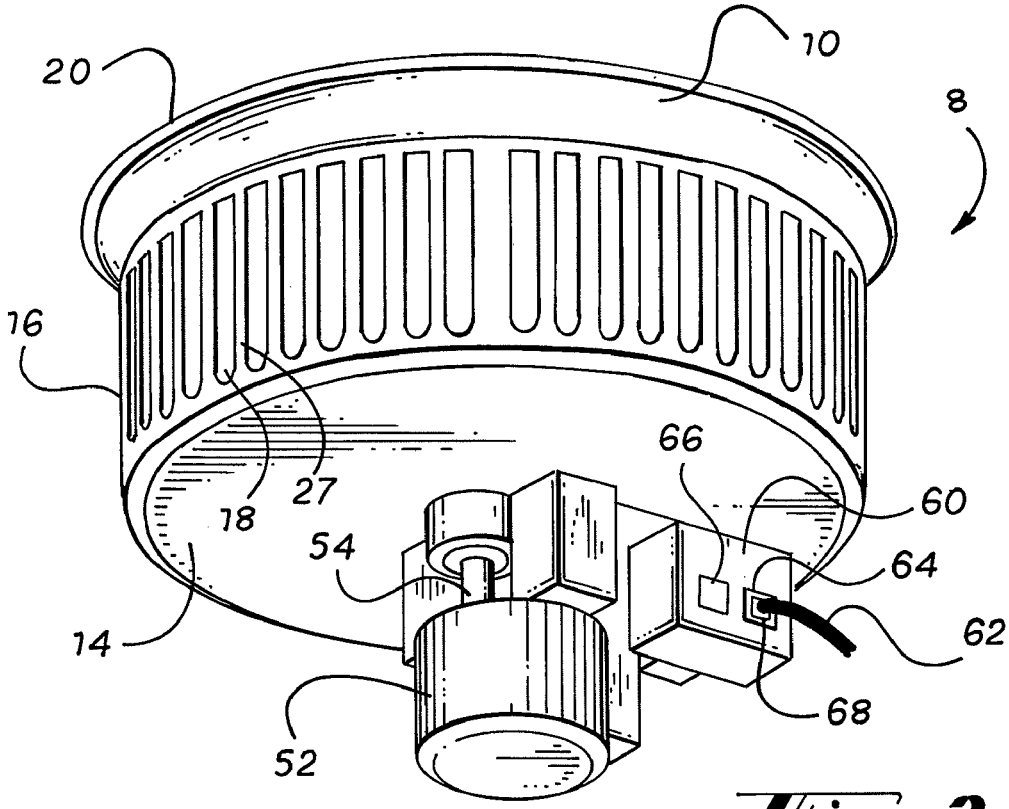
FIG. 2 is a bottom perspective view of the first embodiment of the modular floor terminal basket with a damper in accordance with the present invention.
Figure 3:
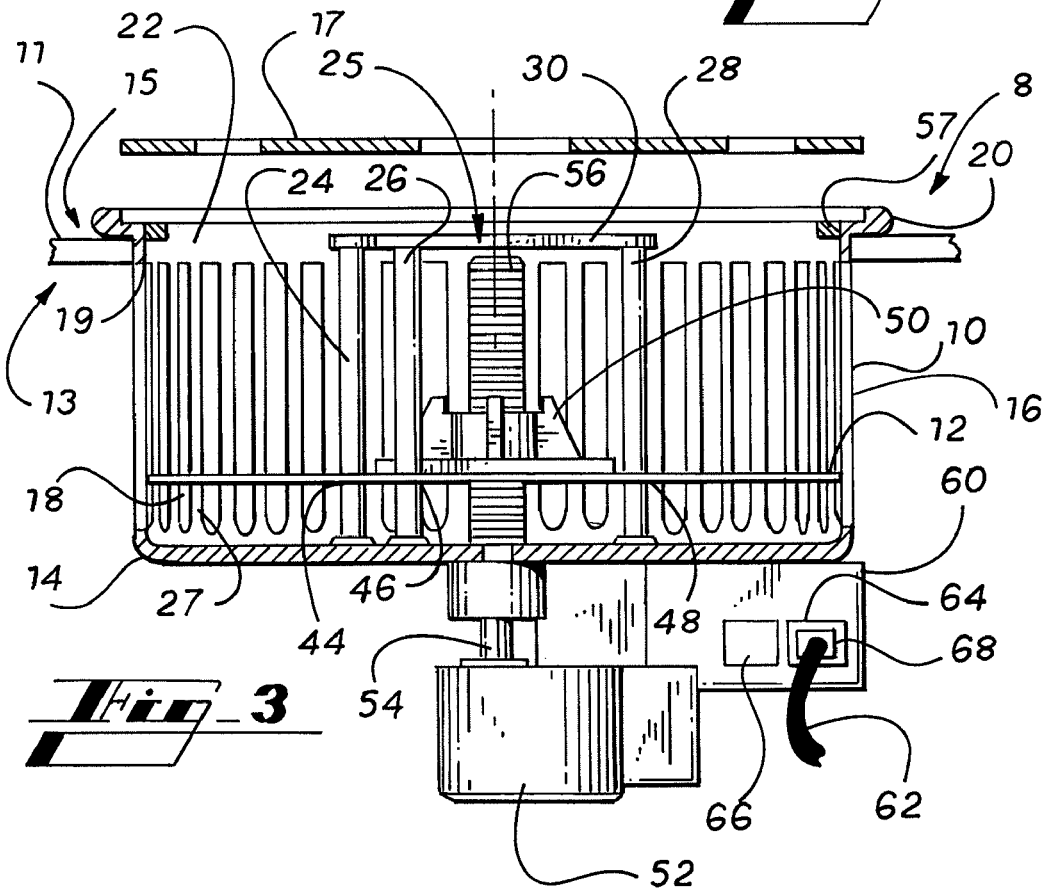
FIG. 3 is a sectional side elevation view of the first embodiment of the modular floor terminal basket with a damper in accordance with the present invention as seen along line 3-3 of FIG. 1.

FIGS. 1, 2, and 3 illustrate a first embodiment of a modular floor terminal basket 8 mounted in an opening 19 of a floor 11. An air plenum 13 is located below the floor 11, and an occupied space 15 is located above the floor 11 (FIG. 3). The modular floor terminal basket 8 comprises a basket 10 and a damper 12. The basket 10 is generally cylindrical and has a closed bottom 14, a peripheral side 16 with columns 27 that define air inlet openings 18, and an upper rim 20 defining an air outlet opening 22.

With reference to FIGS. 1 and 3, the damper 12 is disk shaped and is dimensioned to fit within the cylindrical basket 10. The damper 12 has guide holes 44, 46, and 48. The damper 12 also has a threaded collar 50 attached to the damper 12 at its center.

A damper guide 25 comprises three support rods 24, 26, and 28 that are fixed to the bottom 14 of the basket 10 and extend upwardly. The support rods 24, 26, and 28 are connected at their top ends 34, 36, and 38 respectively by means of a bracket 30. The support rods 24, 26, and 28 engage the guide holes 44, 46, and 48 in the damper 12.

A diffuser grille 17 is mounted in the air outlet opening 22 and is supported by the upper rim 20 of the basket 10. The diffuser grille 17, mounted over the air outlet opening 22, creates an air diffusion pattern as conditioned air flows out of the air outlet opening 22 into the occupied space 15 above the floor 11. A perforated plate (not shown) may be located in the air outlet opening 22 of the basket 10 and may serve as an equalization baffle, ensuring consistent air flow from the air outlet opening 22 to the diffuser grille 17. The perforated plate also may serve to catch debris that might fall into the basket 10 from the occupied space 15 through the diffuser grille 17.

An electric motor of 52 is mounted to the underside of the bottom 14 of the basket 10. The motor 52 has a drive shaft 54 that extends through the bottom 14 of the basket 10. The drive shaft 54 is attached directly to a threaded screw drive 56 that engages the threaded collar 50 attached to the damper 12. As the drive shaft 54 of the motor 52 rotates, the threaded screw drive 56 engages the threaded collar 50 and causes the damper 12 to move up and down along the support rods 24, 26, and 28. The support rods 24, 26, and 28 and the guide holes 44, 46, and 48 keep the damper 12 from rotating.

As the damper 12 slides up along the support rods 24, 26, and 28, the damper 12 progressively closes off the side air inlet openings 18 from communication with the air outlet opening 22 at the top of the basket 10. In its full upper position, the damper 12 engages a gasket 57 located around the upper rim 20 of the basket 10. With the gasket 57 engaged by the damper 12, virtually all the air is shut off to the occupied space 15 above the floor 11.

As the damper 12 slides down along the support rods 24, 26, and 28, the damper 12 progressively opens the side air inlet openings 18 for communication with the air outlet opening 22 at the top of the basket 10. Because of the orientation of the damper 12 within the basket 10, the airflow through the diffuser above the basket 10 will occur over the entire air outlet opening 22 and therefore over the entire area of the diffuser grille 17. Because the electric motor 52 is directly coupled to the threaded screw drive 56, the damper operation will be quiet, will be precise, and will have an extended life expectancy.

The basket 10 with the rim 20 is designed to integrate into the existing round floor diffuser opening 19. The rim 20 allows easy installation from the room side 15 of the raised floor 11 by simply dropping the basket 10 into the round opening 19 in the floor 11.

A signal converter 60 controls the operation of the electric motor 52. The signal converter 60 receives a control signal through a control cable 62 with a plug 68 that is plugged into a receptacle 64 on the converter 60. The control cable 62 with the plug 68 and the receptacle 64 allow for convenient and easy plug and play installation. The signal converter 60 also includes an output receptacle 66 for the signal to be carried to the next terminal if installed in a daisy-chain manner.

Figure 4:
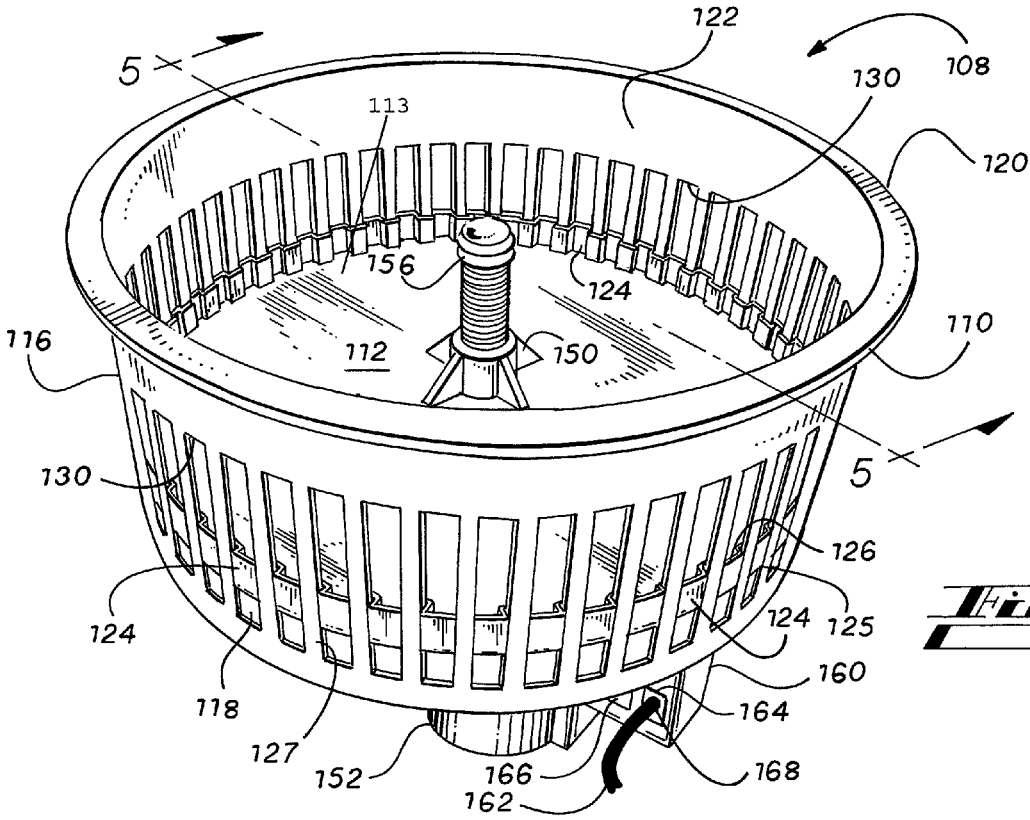
FIG. 4 is a side perspective view of an alternative embodiment of the modular floor terminal basket with a damper in accordance with the present invention.
Figure 5:
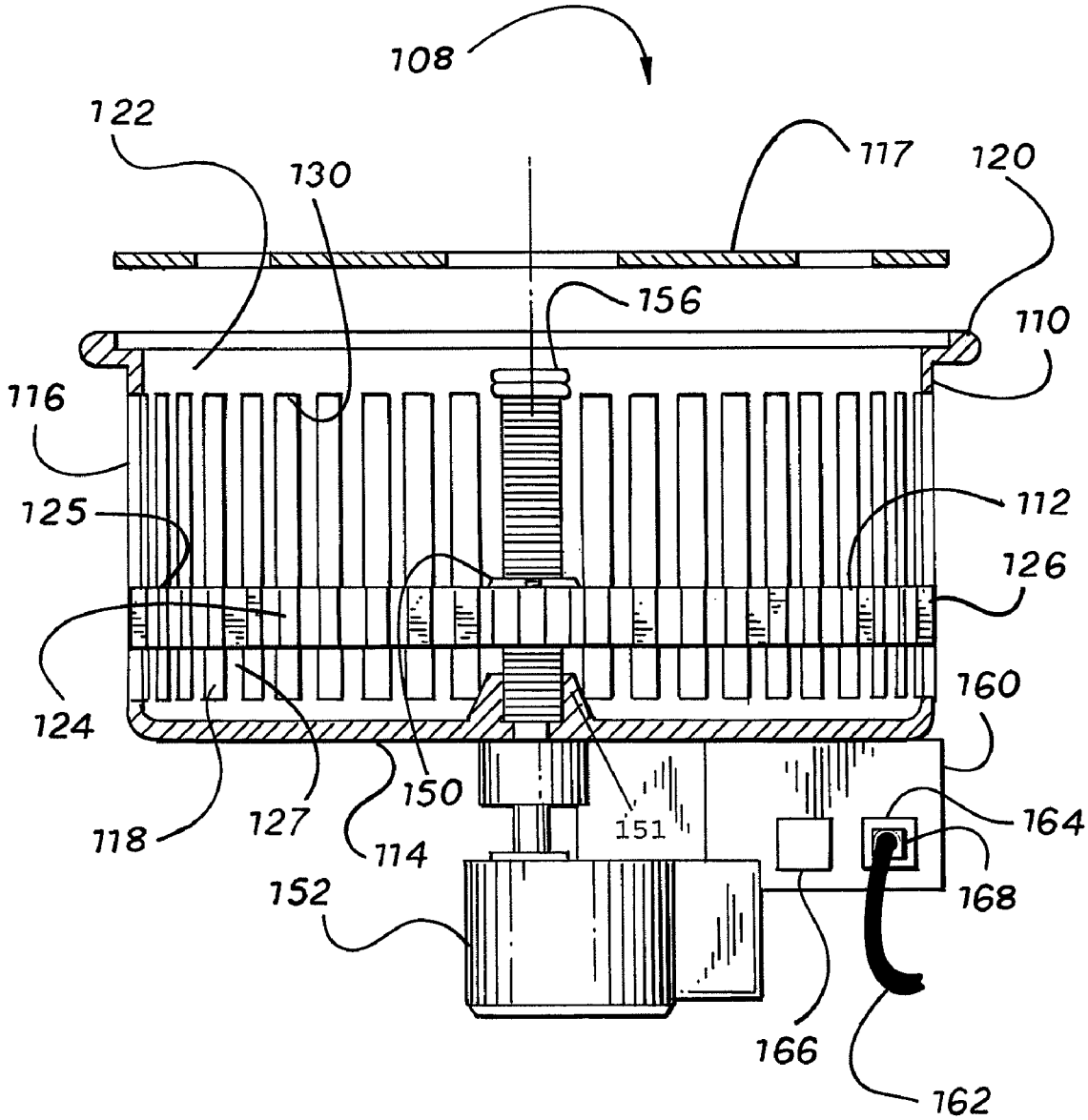
FIG. 5 is a sectional side elevation view of the alternative embodiment of the modular floor terminal basket with a damper in accordance with the present invention as seen along line 5-5 of FIG. 4.

FIGS. 4 and 5 illustrate an alternative embodiment of a modular floor terminal basket 108 mounted in the opening 19 of the floor 11 (FIG. 3). The modular floor terminal basket 108 comprises a basket 110 and a damper 112. The basket 110 is generally cylindrical and has a closed bottom 114, a peripheral side 116 with columns 127 that define air inlet openings 118 with tops 130, and an upper rim 120 defining an air outlet opening 122.

With reference to FIGS. 4 and 5, the damper 112 is pan shaped with a bottom 113 and a circumferential side 126 extending upward from the bottom 113 of the damper 112. The damper 112 is dimensioned to fit within the cylindrical basket 110. A damper guide 125 comprises the columns 127 and rectangular protrusions 124 spaced around the circumferential side 126 of the damper 112. The rectangular protrusions 124 extend into the air inlet openings 118 and engage the columns 127 of the peripheral side 116. The damper 112 also has a threaded collar 150 attached to the bottom 113 of the damper 112 at its center. The threaded collar 150 extends upwardly from the bottom 113 of the damper 112 to a height at least equal to the height of the circumferential side 126.

A diffuser grille 117 is mounted in the opening 122 and is supported by the upper rim 120 of the basket 110. The diffuser grille 117, mounted over the air outlet opening 122, creates an air diffusion pattern as conditioned air flows out of the air outlet opening 122 into the occupied space 15 above the floor 11. A perforated plate (not shown) may be located in the air outlet opening 122 of the basket 110 and may serve as an equalization baffle, ensuring consistent air flow from the air outlet opening 122 to the diffuser grille 117. The perforated plate also may serve to catch debris that might fall into the basket 110 from the occupied space 15 through the diffuser grille 117. An electric motor of 152 is mounted to the underside of the bottom 114 of the basket 110. The motor 152 has a drive shaft 154 that extends through the bottom 114 of the basket 110. The drive shaft 154 is attached directly to a threaded screw drive 156. The threaded screw drive 156 extends through an upwardly extending sleeve 151 that keeps the threaded screw drive 156 perpendicular to the bottom 113 of the basket 110 so that the damper 112 does not become misaligned with the basket 110 and bind on the columns 127 of the basket 110. The threaded screw drive 156 engages the threaded collar 150 attached to the damper 112. As the drive shaft 154 of the motor 152 rotates, the threaded screw drive 156 engages the threaded collar 150 and causes the damper 112 to move up and down along the damper guide 125. The engagement of the rectangular protrusions 124 with the air inlet openings 118 of the damper guide 125 keeps the damper 112 from rotating.

As the damper 112 slides up along the damper guide 125, the damper 112 progressively closes off the side air inlet openings 118 from communication with the air outlet opening 122 at the top of the basket 10. When the damper 112 is in its full upper position, the rectangular protrusions 124 within the air inlet openings 118 engage the tops 130 of the air inlet openings 118. With the protrusions 124 engaging the tops 130 of the air inlet openings 118, virtually all the air is shut off to the occupied space 15 above the floor 11.

As the damper 112 slides down along the damper guide 125, the damper 112 progressively opens the side air inlet openings 118 for communication with the air outlet opening 122 at the top of the basket 110. Because of the orientation of the damper 112 within the basket 110, the airflow through the diffuser above the basket 110 will occur over the entire outlet opening 122 and therefore over the entire area of the diffuser grille 117 thus assuring that the diffuser grille 117 produces its intended diffusion pattern. Because the electric motor 152 is directly coupled to the threaded screw drive 156, the damper operation will be quiet, will be precise, and will have an extended life expectancy.

The basket 110 with the rim 120 is designed to integrate into the existing round floor diffuser opening 19. The rim 120 allows easy installation from the room side 15 of the raised floor 11 by simply dropping the basket 110 into the round opening 19 in the floor 11. In addition, the pan shape of the damper 112 along with the threaded collar 150 allows the damper 112 to catch and hold liquid and other debris spilled through the diffuser grille 117. The circumferential side 126 keeps spilled liquid from running out of the basket 110 into the air plenum 13 through the air inlet openings 118, and the threaded collar 150 keeps spilled liquid from running out of the basket 110 into the air plenum 13 around the threaded screw drive 156. The capacity of the damper 112 to hold liquid and debris is established by the height of the circumferential side 126 and the height of the threaded collar 150.

A signal converter 160 controls the operation of the electric motor 152. The signal converter 160 receives a control signal through a control cable 162 with a plug 168 that is plugged into a receptacle 164 on the converter 160. The control cable 162 with the plug 168 and the receptacle 164 allow for convenient and easy plug and play installation. The signal converter 160 also includes an output receptacle 166 for the signal to be carried to the next terminal if installed in a daisy-chain manner.

While this invention has been described with reference to preferred embodiments thereof, it is to be understood that variations and modifications can be affected within the spirit and scope of the invention as described herein and as described in the appended claims.

We claim:

1. A modular floor terminal basket mounted in a floor with an air plenum below and an occupied space above, wherein the modular floor terminal basket controls flow of conditioned air from the air plenum to the occupied space, and comprising:

a. a basket supported by the floor and extending into the air plenum below the floor and having:

i. a top with an air outlet;

ii. a side with an air inlet wherein the side comprises vertically extending columns; and iii. a bottom directly affixed to the side;

b. a damper having an edge for engaging the vertically extending columns for movement between an opened position adjacent the bottom of the basket and a closed position adjacent the top of the basket;

c. a damper drive for driving the damper between the opened position adjacent the bottom of the basket and the closed position adjacent the top of the basket comprising:

i. a threaded collar immovably affixed to the damper;

ii. threaded screw drive for threadably engaging the threaded collar; and iii. a motor connected to the threaded screw drive for rotating the threaded screw drive;

wherein the edge of the damper has protrusions that engage the vertically extending columns, wherein the columns define the air inlet including a top of the air inlet, and wherein the protrusions on the edge of the damper extend into the air inlet and, when the damper is in an upper closed position, the protrusions engage the top of the air inlet to shut off the flow of conditioned air from the air plenum to the occupied space.

* * * * *